US008545226B2

(12) United States Patent
Norden et al.

(10) Patent No.: US 8,545,226 B2
(45) Date of Patent: Oct. 1, 2013

(54) FIREARM SHOOTING SIMULATOR

(75) Inventors: Christian Emmanuel Norden, Lyttleton (ZA); Alan Trevor Brown, Meyerspark (ZA)

(73) Assignee: Christian Emmanuel Norden, Lyttleton (ZA)

( * ) Notice: Subject to any disclaimer, the term of this patent is extended or adjusted under 35 U.S.C. 154(b) by 862 days.

(21) Appl. No.: 12/526,931

(22) PCT Filed: Feb. 22, 2008

(86) PCT No.: PCT/ZA2008/000016

§ 371 (c)(1),
(2), (4) Date: Jan. 5, 2010

(87) PCT Pub. No.: WO2008/104008

PCT Pub. Date: Aug. 28, 2008

(65) Prior Publication Data

US 2010/0145669 A1 Jun. 10, 2010

(30) Foreign Application Priority Data

Feb. 23, 2007 (ZA) ..... 2007/01603

(51) Int. Cl.
*F41G 3/26* (2006.01)

(52) U.S. Cl.
USPC ..... 434/19; 434/21

(58) Field of Classification Search
USPC ..... 434/11–26; 235/404; 348/61; 702/104; 42/130
See application file for complete search history.

(56) References Cited

U.S. PATENT DOCUMENTS

| | | | | |
|---|---|---|---|---|
| 2001/0047248 | A1 | 11/2001 | Toth et al. | |
| 2002/0197584 | A1 | 12/2002 | Kendir et al. | |
| 2005/0018041 | A1 | 1/2005 | Towery et al. | |
| 2005/0268521 | A1 * | 12/2005 | Cox et al. | 42/130 |
| 2011/0300515 | A1 * | 12/2011 | Chung | 434/22 |

FOREIGN PATENT DOCUMENTS

| | | |
|---|---|---|
| WO | WO 92/08093 | 5/1992 |

* cited by examiner

*Primary Examiner* — Timothy A Musselman
(74) *Attorney, Agent, or Firm* — Merchant & Gould P.C.

(57) ABSTRACT

A firearm shooting simulator includes an image capturing device fitted to a firearm and configured to capture at least one image of a target, once activated. The system further includes a processor which is configured to determine any variance between a center point of the image captured and a point on the target sighted by the firearm when the image is captured. This is achieved by sighting the firearm at a particular point on the target and programming the processor with the location of this sighted point. Once the processor is aware of which point is sighted by the firearm, the image is captured and the processor determines a center point of the image captured.

20 Claims, 7 Drawing Sheets

FIREARM SHOOTING SIMULATOR

This application is a National Stage Application of PCT/ZA2008/000016, filed 22 Feb. 2008, which claims benefit of Serial No. 2007/01603, filed 23 Feb. 2007 in South Africa and which applications are incorporated herein by reference. To the extent appropriate, a claim of priority is made to each of the above disclosed applications.

FIELD OF THE INVENTION

This invention relates to a firearm target shooting simulator, and an automatic zeroing and triggering mechanism for a firearm shooting simulator.

BACKGROUND TO THE INVENTION

Zeroing a firearm or a firearm shooting simulator is often an arduous and time-consuming task. Laser zeroing techniques have developed which allow a person the use of a laser or similar beam emitter to zero a firearm without requiring a shot to be fired. These systems have also found applications in firearm training, where image capturing devices or lasers may be used to simulate firing of a firearm.

A problem associated with these zeroing and simulator systems, is the requirement that the laser beam must typically be aligned with the sights of the firearm in order to provide accurate use thereof. In essence, the laser beam represents a virtual bullet discharged from the simulator. Further problems associated with these systems are securing a zeroing system or simulator to a firearm in a manner which allows repeatable use whilst maintaining accuracy, and triggering the simulator or sighting system in a reliable manner.

Accordingly, a further problem with existing simulators for use inside a breech or barrel of a firearm or for attachment to an outside part of the firearm are weight and size constraints of power and electronic hardware to be attached to such a firearm.

The current invention seeks to propose possible solutions to the above problems.

In the specification, the term "zeroing" is to be interpreted as referring to setting the sights of a firearm or firearm shooting simulator for firing or dry-firing i.e. calibrating the simulator to automatically compensate for the offset between firearm sight point and simulator hit point on the target. The term "firearm" is to be interpreted as including a real firearm, a simulated firearm, and a mock-up firearm.

The term "sight" when used as a verb is to be understood as meaning to take aim by looking through the sights of a firearm or firearm shooting simulator.

SUMMARY OF THE INVENTION

According to the invention, there is provided a zeroing method for a firearm shooting simulator, which method includes at least the steps of:—

- sighting a firearm having an image capturing device associated therewith, aiming at a first point on a target;
- capturing at least one image of the target;
- automatically determining a second point on the target corresponding to a centre of the image captured;
- automatically determining any variance between the first and second points; and
- when the firearm shooting simulator is in a post-zeroing, shooting condition, automatically compensating for the variance when further images are captured, so that accurate zeroing of the firearm shooting simulator at the target is achievable without having to precisely align two or more of the image capturing device, a barrel of the firearm, and a sight of the firearm with each other.

The centre of the image captured may be the real centre thereof. Alternatively, it may represent a selected reference point on the image captured, which point does not correspond to the real centre of the image.

Accordingly, a centre of further images captured may not necessarily correspond to a centre of the target.

The first point may be a centre of the target.

The target may be a reference system representing the target.

The target may be a conventional target for a user to aim at. An associated, but separate target may be provided for the image capturing device, the target including a set of markers. The image captured by the image capturing device may be used to calculate simulated shooting results.

The method may further include the step of automatically creating a virtual target centre by calculating the mean point of impact (MPI) using one or more second points, for scoring purposes.

Second points that are unwanted and/or are further than a predetermined distance from the MPI may be discarded during zeroing.

Accordingly, when a user of the simulator takes aim at the (real) target centre and perfectly aligns the simulator with the target centre, this will result in a centre hit on the MPI and the shot will be registered as having hit the centre of the target.

Similarly, a virtual target hit at a particular distance and direction from the MPI will be registered as a hit on the real target at the same distance and direction from the target centre.

The method may include the further step of adjusting the variance in distance and direction between the target centre and the MPI.

It is to be appreciated that, by determining the variance between the sighted point on the target and the centre of the image captured, it is unnecessary to align the image capturing device with the sights of the firearm. This alignment is typically time consuming, difficult to achieve and to maintain given that the image taking device must be removable to allow normal operation of the firearm. In effect, by automatically compensating for the variance between the firearm's sights and the centre point of the image captured, a virtual bull's-eye is created.

The step of zeroing the firearm may include aligning the sights of the firearm using mechanical means.

The step of capturing at least one image may include capturing multiple images of the target in order to calculate a mean point of impact (MPI) from a plurality of second points.

The step of determining the variance may include quantifying the distance and direction of the variance between the first and second points.

The variance for a particular firearm located a known distance from a target may be stored in a memory arrangement from which this information is retrievable. The capturing of the one or more images may be triggered by a predetermined signal associated with dry-firing, firing, or triggering of the firearm.

In an alternative embodiment of the invention, the simulator may have an electromagnetic beam emitter and the step of capturing one or more images may be replaced with a step of emitting at least one beam towards the target, the point of impact of the beam on the target representing the second point.

According to a further aspect of the invention, there is provided a firearm shooting simulator system including:— an image capturing device configured for fitment to a firearm, in use, which device is configured to capture at least one image of a target, wherein a centre of said image represents a virtual point of impact on the target;

a processor arranged in communication with the image capturing device, which processor is configured to determine any variance between said virtual point of impact and a point on the target sighted by the firearm when the image is captured, and to compensate for such variance when further images are captured during simulator shooting; and a reporting mechanism arranged in communication with the processor, which reporting mechanism is configured to indicate where the firearm is sighted at the target once further images are captured and the variance compensated for, as compensation for the variance obviates alignment of the image capturing device with a sight of the firearm.

The image capturing device may be selected from the group including: a digital camera, a conventional camera, a video camera, and a webcam.

The processor may be configured to determine the variance by quantifying the distance and direction of the variance between the virtual point of impact and the point sighted by the firearm.

The processor may compensate for the variance by adjusting the virtual point of impact of a further image captured during simulator shooting by the variance so that further virtual points of impact are automatically adjusted with such variance.

The processor may be configured to determine the variance by considering multiple images captured of the target in order to determine a mean point of impact (MPI) of the plurality of virtual points of impact.

The target may include a set of markers which may be coded and may be in the form of, for example, LED's. The markers may be used to calculate a location of a virtual point of impact and to identify which target is hit. The markers may further be used to calculate a distance between the shooting simulator (and thereby the firearm) and the target.

It is to be appreciated that the processor typically performs its various tasks and configurations by executing a specific set of instructions, e.g. software commands running on a suitable computer system, or the like.

The MPI for a particular firearm located a known distance from a target may be stored in a memory arrangement from which this information may be retrievable.

The memory arrangement may store a plurality of mean points of impact, each MPI being associated with a particular firearm located at a particular distance from the target so that a user may select an MPI associated with a particular firearm located at a particular distance from the target.

The capturing of the one or more images may be triggered by a predetermined signal associated with dry-firing, firing, or triggering of the firearm.

The processor may download a predetermined portion of the image captured of the target, wherein the size of the portion downloaded may be a fraction of the size of the entire target.

The processor may download a predetermined portion of the image captured of the target, wherein the downloaded portion may overlay the captured target image. The captured target image centre may be located at or close to the centre of the downloaded portion. The size and/or shape of the downloaded portion may be adjustable.

The system may include a sensor for sensing when the firearm is triggered and an actuator configured to monitor the sensor. The actuator may be configured to activate the image capturing device when a predetermined signal is sensed by the sensor, so that the image capturing device is only activated upon receipt of such predetermined signal.

The sensor may be selected from an acoustic sensor and a vibration sensor.

It is to be appreciated that the sensor may include any suitable sensor able to sense triggering of the firearm, e.g. when a trigger is pulled, when a firing pin, hammer, or striker is actuated or impacts upon a portion of the firearm, or the like.

The predetermined signal may include particular characteristics selected from the group including: amplitude-time, frequency spectrum, and amplitude-time and frequency spectrum.

The predetermined signal may include a peak level of amplitude and a predetermined interval of amplitude before and after said peak. It is to be appreciated, that the measured values are located within a suitable uncertainty window around the signal intensity level over the time period involved.

In an adjustment mode, the actuator may be configured to record the predetermined signal and to store it.

The actuator may be capable of storing a plurality of predetermined signals, wherein each predetermined signal may be associated with a particular firearm, and wherein the user has a choice which signal to use and which to delete.

Triggering of the firearm may produce more than one predetermined signal and wherein said more than one signal may trigger the image capturing device.

Virtual points of impact of further images captured which fall outside a predetermined distance away from the image captured may not be registered by the processor and may therefore not be taken into account when determining the MPI or when determining results of a training session using the system.

The reporting mechanism may include a display which may show a virtual representation of the target with an indication of where the virtual points of impact are located. The indication of where the virtual points of impact are located may automatically include the compensation of the variance.

The system may be operable in a plurality of selectable modes such as a shooting mode, in which a single image is captured upon dry-firing, firing, or triggering of the firearm, and a tracing mode, in which images are captured at set time intervals so that movement of the firearm barrel during zeroing, aiming, or shooting is traceable.

In an alternative embodiment of the invention, the image capturing device may be replaced with an electromagnetic beam emitter in which case the virtual point of impact may be a point at which the beam hits the target when the firearm is triggered.

A scanner may be provided to automatically determine a point where the beam hits the target.

The scanner may form part of the target and may be configured to detect and pinpoint where the beam strikes the target. The target may include photosensors for sensing the point of impact of the beam with the target.

The target of the system may include a plurality of layers having different colours and diffusivity, and may be configured so that an electromagnetic beam striking the target, in use, passes through similar layers irrespective of where the beam hits the target.

The target may include first and second layers, one of which may be strongly pigmented so as to act as a diffuser layer and a background layer and a second layer that may be darker in colour than the first layer and may act as a target centre and aim area.

A rigid, transparent sheet may be used as a base onto which the aim area is printed or painted using a material that is substantially transparent, displays little diffusivity, and is preferably red in colour.

A layer of diffusive material covering the entire target area may thereafter be added, after which a final layer is added which is substantially transparent, displays little diffusivity, and is preferably red in colour and which covers the entire target area except the aim area of the target.

The system may include an attachment mechanism for the image capturing device, which attachment mechanism includes:

an expandable sleeve shaped and configured for insertion, in use, into a barrel of a firearm;

a spindle within the sleeve, which spindle is configured to extend beyond one end of the sleeve to enable manual lateral movement of the spindle inside the sleeve; and at least one collet with wedge on the spindle, which collet is configured to move laterally on the spindle to expand the sleeve to frictionally engage the inside of the barrel when the collet is moved on the spindle, while a wedge fixed on an opposed end of the spindle expands the sleeve on said end.

The attachment mechanism may include positioning means configured to position the attachment means in relation to a particular portion of the firearm, the spindle including securing means for securing the sleeve to the spindle to inhibit rotation of the sleeve about the spindle, to permit accurate repeatability when removing and re-attaching the attachment mechanism to the firearm.

The positioning means may engage a front sight of the firearm, a recoil spring housing, an ejector housing, or the like.

The sleeve may be expandable by including at least two arcuate sleeve portions configured to be pressed apart by the wedges, in use.

Both wedges may be configured to expand the sleeve by being tapered towards the expandable sleeve, so that when the collet is displaced along the spindle, the tapered parts expand the sleeve.

It is to be appreciated, that inaccuracies in concentricities of parts is minimized by having the same parts of contact surfaces of the mechanism in contact with each other and with the barrel of the firearm. Similarly, the parts are always orientated at the same angle with respect to the barrel axis.

BRIEF DESCRIPTION OF THE DRAWINGS

The invention is now described, by way of non-limiting example, with reference to the accompanying drawings wherein.

DETAILED DESCRIPTION OF THE INVENTION

Figure 1:
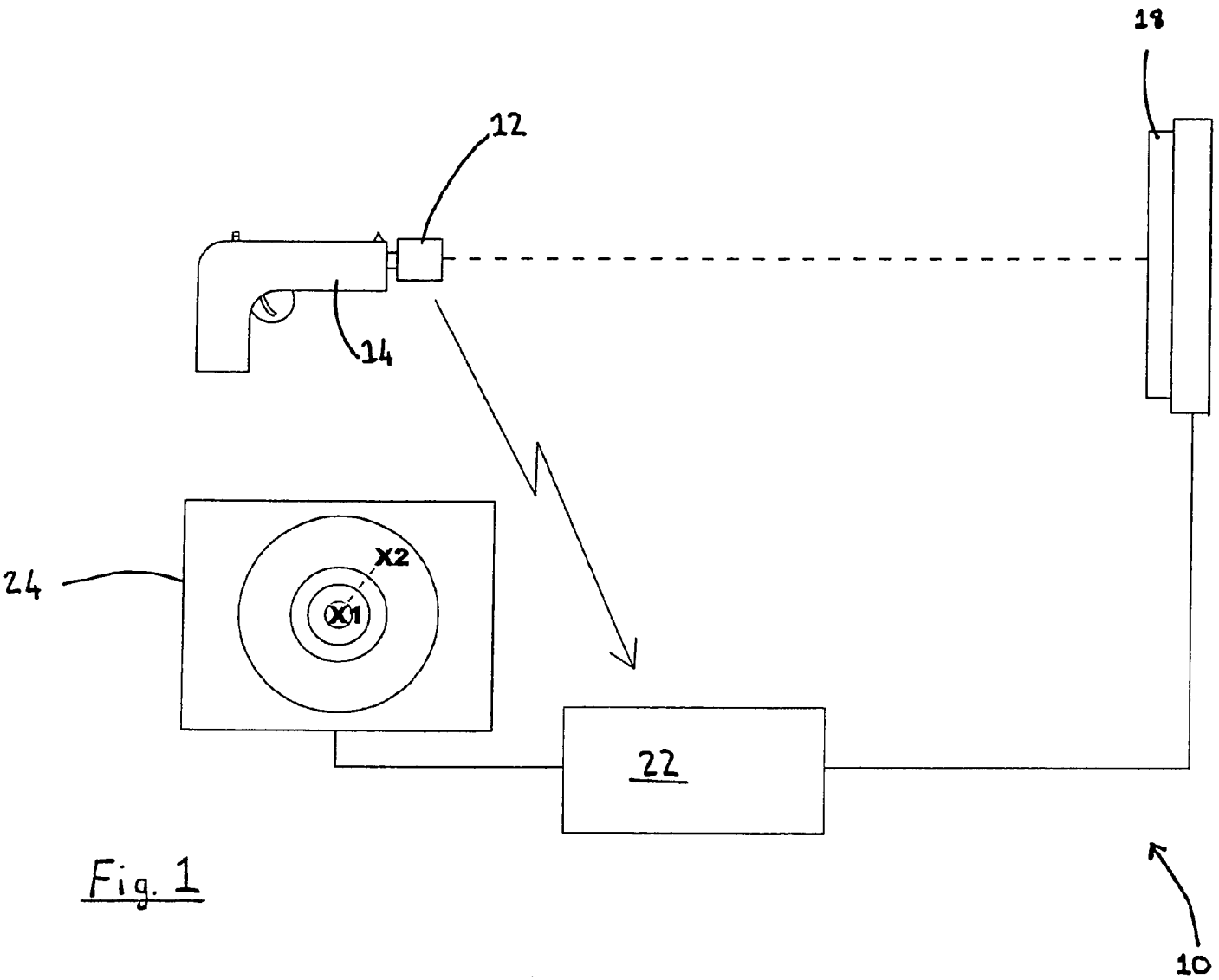
FIG. 1 shows, in diagrammatic view, a firearm shooting simulator, in accordance with the invention.

With reference to the accompanying drawings, a firearm shooting simulator, in accordance with the invention, is generally indicated by reference numeral 10.

The firearm shooting simulator 10, as shown in FIG. 1, generally includes an image capturing device 12 fitted to a firearm 14. Also included is a target 18 with a processor 22 and a reporting mechanism 24. It is to be appreciated that the firearm 14 may include any type of firearm, such as a pistol, a revolver, a rifle, or the like. The system 10 is applicable to any such different types of firearms. In the embodiment shown, the firearm 14 comprises a pistol.

The image capturing device 12, fitted to the firearm 14, is configured to capture at least one image of the target 18, once activated. The image capturing device is typically a digital camera and the image is thus a digital image.

The system 10 further includes a processor 22 which is configured to determine any variance between a centre point of the image captured and a point on the target sighted by the firearm 14 when the image is captured. This is typically achieved by sighting the firearm 14 at a particular point on the target 18 and programming the processor 22 with the location of this sighted point, e.g. sighting the "bull's-eye" on the target 18. Once the processor 22 is aware of which point is sighted by the firearm 14, the image is captured and the processor 22 determines a centre point of the image captured. By knowing the sighted point and determining the centre point of the image captured, the processor 22 is able to determine the variance between these two points. The processor 22 is then further configured to compensate for such variance when further images are captured by the image capturing device 12.

It is to be appreciated that the processor 22 may form part of the image capturing device or camera and is not limited to being a separate component as shown in the drawings. As such, there may be a signal link (preferably RF or IR) between a part of the processor on the image capturing device 12 and the processor 22. Alternatively, the processor 22 may be mounted on the firearm 14 and form part of the image capturing device 12.

It is to be appreciated that by the processor 22 automatically compensating for the variance between where the centre point of the image captured will be and the sights of the firearm 14, it is possible to practice with the firearm without having to zero the firearm 14 or the image capturing device 12 on the centre point of the target 18.

The processor 22 may be configured to determine the variance by quantifying the distance and direction of the variance from the point sighted by the firearm, e.g. storing the variance. After zeroing has been completed, the processor 22 may compensate for the variance by adjusting the centre point of a further image captured with the variance, e.g. once the variance is determined, further images captured during simulator shooting are automatically adjusted with such variance to determine accuracy of these further images.

In one embodiment, the processor 22 is configured to determine the variance by considering multiple images captured of the target 18 in order to determine the variance statistically, e.g. a plurality of images of the target 18 are captured and a virtual "bull's-eye" is determined according to the mean point of impact of the plurality of centre points of the images captured.

It is to be appreciated that the processor typically performs its various tasks and configurations by executing a specific set of instructions, e.g. software commands running on a suitable computer or microprocessor system, or the like.

The system 10 also includes a reporting mechanism 24 arranged in communication with the processor 22. The reporting mechanism is configured to indicate where the sights of the firearm 14 are sighted on the target 18 according to the compensation for the variance by the processor 22, as described above. In the embodiment shown, the reporting mechanism 24 includes a display, such as a screen, which shows a representation of the target 18. The reporting mechanism 24 can be integral with the image capturing device 12 or it can be located remote from the device 12.

For example, the firearm 14 is sighted to a first point X1, as shown in FIG. 1, which point is at the centre or "bull's-eye" of the target 18. The image capturing device 12 now captures an image of the target. The centre point of the image taken is a second point X2, as shown. The variance determined by the processor 22 is then the distance and direction of point X2 from point X1, and this variance is automatically compensated for when further images are captured during simulator shooting. In another embodiment, multiple images are captured and the mean point of impact is statistically determined, e.g. point X2. In this manner, after adjustment the reporting mechanism 24 will automatically report a hit at point X2 as a hit at the centre of the target 18, i.e. at X1. It is to be appreciated, that image capturing device 12 can operate in various manners, for example, it could capture images at set time intervals, continuously, and so on.

As mentioned above, it is to be appreciated that by determining the variance between the sighted point on the target (X1) and the actual point (X2) that is the centre of the image captured, it is unnecessary to align the image capturing device 12 with the sights of the firearm 14. This alignment is typically difficult to achieve and to maintain given that the image capturing device 12 must be removable to allow normal operation of the firearm 14. In effect, by automatically compensating for the variance between the firearm's sights and an image taken by the image capturing device 12, a virtual bull's-eye is created.

A perfect aim at the target centre or bull's-eye will thus result in a centre hit on the Mean point of impact (MPI), and the simulator 10 will register the hit result as having hit the target centre or bull's-eye. The control system 22 will have the capability, when in a proper adjustment mode, to adjust the offset between the target centre and the MPI, when needed. When in this adjustment mode, a user will be able to erase specific shots from the variance so as not to adversely affect the MPI when so determined. The user will also have the capability to clear the device 22 memory of any previous MPI value(s), and the possibility can be created to simultaneously store the MPI value of more than one firearm.

When in the zeroing mode, the system 10 may be programmed to automatically discard hits which fall outside a certain tolerance of the MPI. The image capturing device 12 mounted on the firearm 14 may be articulated and adjustable to enable an aimed hit at the target 18 to facilitate an approximate procedure of zeroing before the zeroing mode adjustments are made by the processor 22.

Figure 2A:
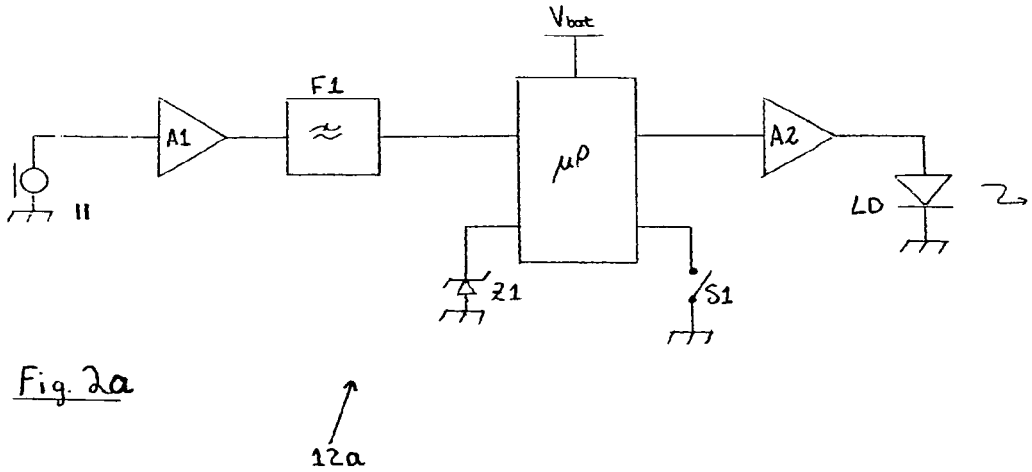
FIG. 2*a* shows an operational block diagram of an electromagnetic beam emitter for use with the firearm shooting simulator.

FIG. 2*a* shows an operational block diagram of an electromagnetic beam emitter 12*a* for use with the firearm shooting simulator. When a suitable triggering mechanism such as, for example, a microphone 11, detects a sound or vibration resulting from the firearm's trigger action, the amplifier A1 and filter F1 processes the resulting waveform. Microprocessor μP samples the input waveform and activates laser diode LD via associated buffer amplifier A2. Zener diode Z1 provides a reference voltage for the purpose of monitoring a battery status of the emitter 12*a*, and switch S1 enables switching of the emitter 12*a* control system.

In addition, switch S1 further enables selection of operating modes or channels, which refers to the control system's modes of operation into which it may be switched for different operational uses, such as adjustment mode, reset applications, zeroing mode, sensitivity adjustments, and the like.

Figure 2B:
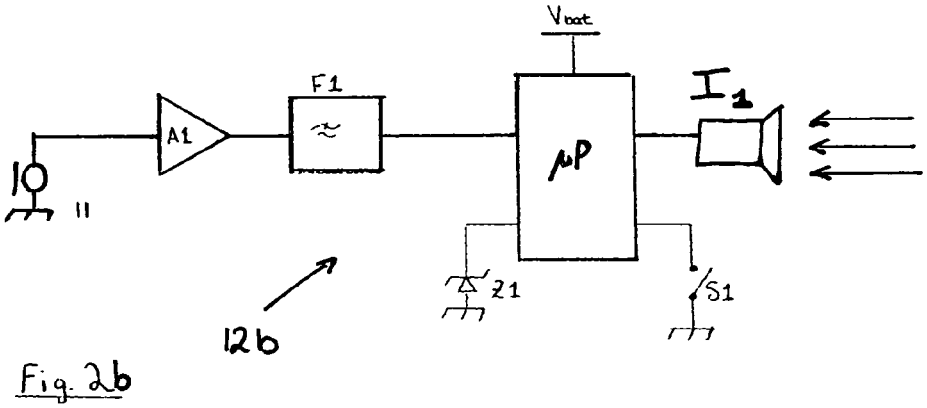
FIG. 2*b* shows an operational block diagram of an image capturing device for use with the firearm shooting simulator.

FIG. 2*b* shows an operational block diagram of an image capturing device 12*b* for use with the firearm shooting simulator. A miniature image sensor $I_1$ is connected via a port to a microprocessor μP. When a suitable triggering mechanism, e.g. a microphone 11 detects a sound or vibration resulting from the trigger action of the firearm, the amplifier A1 and filter F1 process the resulting waveform. If the waveform is recognized as being associated with a firing action, an image is captured by the image capturing device and transmitted to the microprocessor μP.

Figure 3:
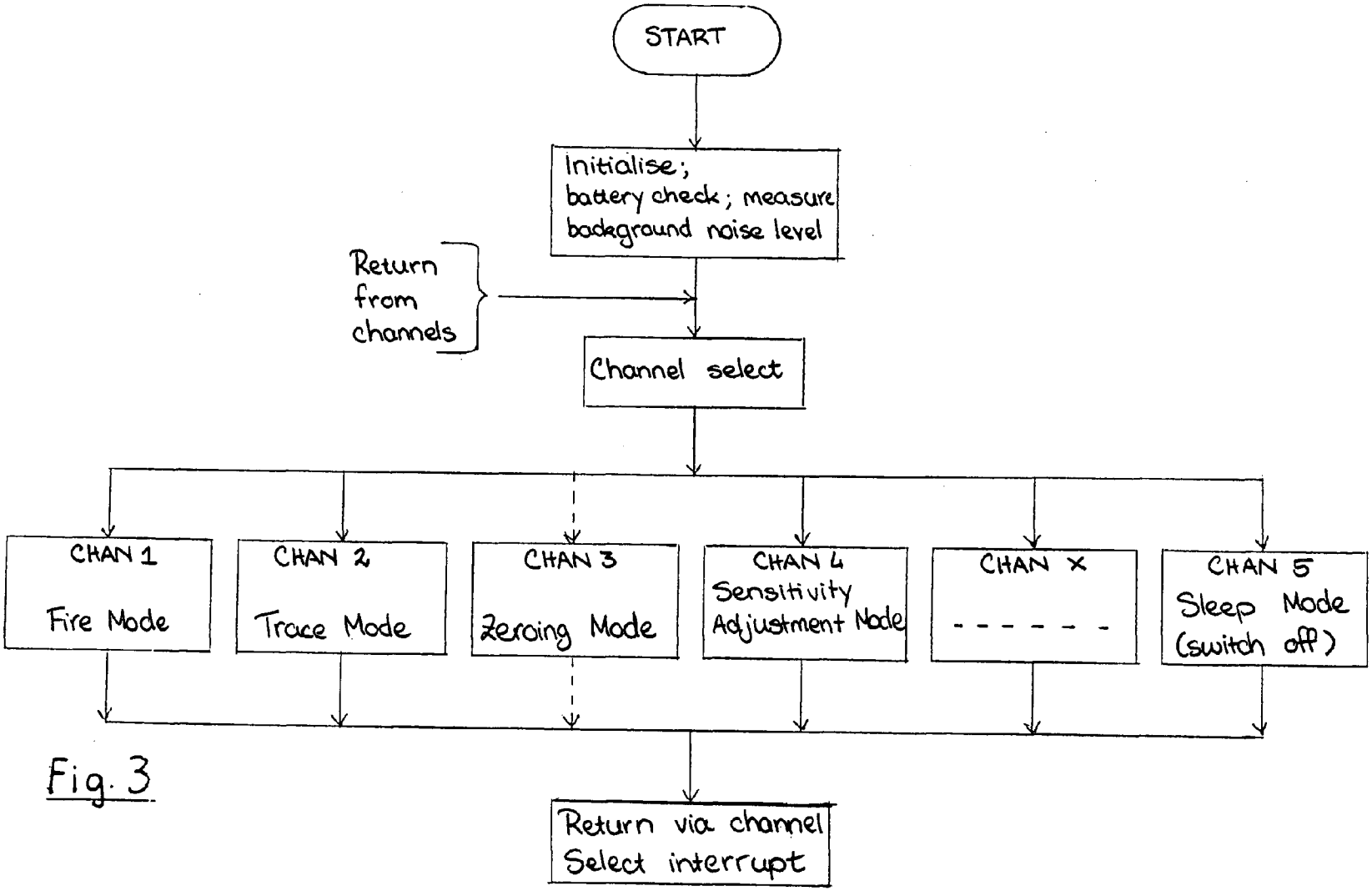
FIG. 3 shows a high level flow diagram of an embodiment of a firearm shooting simulator.

With reference to FIG. 3, a flow diagram for the control system for the image capturing device 12, in accordance with the invention, is shown. A switch is used to select a mode or channel (CHAN), as indicated. Channel 1 represents a normal operational mode when the firearm 14 is used for target practice and a user only wants the image capturing device 12 to capture a single image when the weapon is triggered. Channel 2 switches the simulator into a trace mode, where the image capturing device is constantly capturing successive images. Channel 3 switches the simulator into the zeroing mode, and channel 4 switches the device into the triggering sensitivity adjustment mode, such as acoustic envelope detection mode, or the like. In the embodiment shown, channel 5 represents an "off" mode.

The control for adjusting the image capturing device 12 into the zeroing mode can be part of this mounting on the firearm 14.

Further channels could include a mode for activating a user identification code in cases where, for example, more than one user simultaneously use one control system, and a mode for interrogation of status and shooting results.

As explained the invention also includes a triggering mechanism for activating the image capturing device 12 shown in FIG. 1. The triggering mechanism generally includes a sensor for sensing when the firearm 14 is triggered, and a processor configured to monitor the sensor, with the processor being further configured to activate the image capturing device 12 when a predetermined signal is sensed by the sensor, so that the image taker 12 is only activated upon receipt of such predetermined signal.

In one embodiment of the invention, the sensor includes an acoustic sensor. In another embodiment of the invention, the sensor includes a vibration sensor, such as a piezo-electric sensor, or the like. It is to be appreciated that the sensor may include any suitable sensor able to sense triggering of the firearm 14, e.g. when a trigger is pulled, when a firing pin, hammer or striker is actuated or impacts with a portion of the firearm, or the like.

Accordingly, the triggering mechanism may be shaped and/or configured for attachment/placement at a specific location on the firearm 14. For example, in one embodiment, the mechanism is shaped and configured to fit inside a breach of the firearm 14 to sense when a firing pin of the firearm strikes the sensor. In another embodiment of the invention, the mechanism is configured for attachment to the image capturing device 12.

It is to be appreciated that the predetermined signal may include particular characteristics, such as duration, amplitude, frequency, or the like. The processor may be configured to record or capture the predetermined signal or part thereof, i.e. to program the signal.

It is to be appreciated that the triggering mechanism enables the image capturing device 12 to be activated upon sensing of a specific characteristic unique to a particular firearm action, as different firearms and their respective actions typically present different acoustic characteristics when triggered. This allows a particular variance, as determined by the system 10 above, to be recorded and stored for use when a particular characteristic is sensed by the sensor. In this manner, the variance detected above may be linked to a specific firearm and automatically compensated for when a firearm's particular firing characteristics are detected.

The sensitivity of the triggering mechanism to initiate the capturing of an image is typically adjusted for a specific firearm by switching the control system on 12 into the sensitivity adjustment mode. In this mode, the control system will monitor the firearm for a specific time period, via the sensor, to sense a specific variation in acoustic amplitude or vibration or frequency over a specific time period. The system then stores a sensed amplitude/time envelope and/or frequency spectrum corresponding to the particular sound or vibration of the firearm being triggered. After this initial calibration has been done, in use, the sensor will continuously monitor the firearm for peak values above a preset threshold level and within a preset tolerance band around the amplitude/time envelope and/or frequency spectrum. Once the calibrated signal is sensed, the image capturing device is activated. The acoustic/vibrational level may include an envelope or a spectrum for a short time period, e.g. 2 milliseconds, or the like, as well as an amplitude level or frequency spectrum over a suitable time period before and/or after the peak period of the signal. The adjusted sensitivity level will remain in the control system of 12 for a certain time period or until a new value is calibrated, the system reset, or the like. The sensitivity adjustment can also be applied to other firearm-mounted devices such as electromagnetic beam emitters or beam sensors.

To counter the effects of a long series of noises, such as when the firearm is cocked, the control system of 12 is able to ignore long periods of noise, e.g., a noticeable vibration which approaches triggering of the mechanism can result in a period of, for example, 50 millisecond delay during which all noise is ignored by the sensor.

Figure 4:
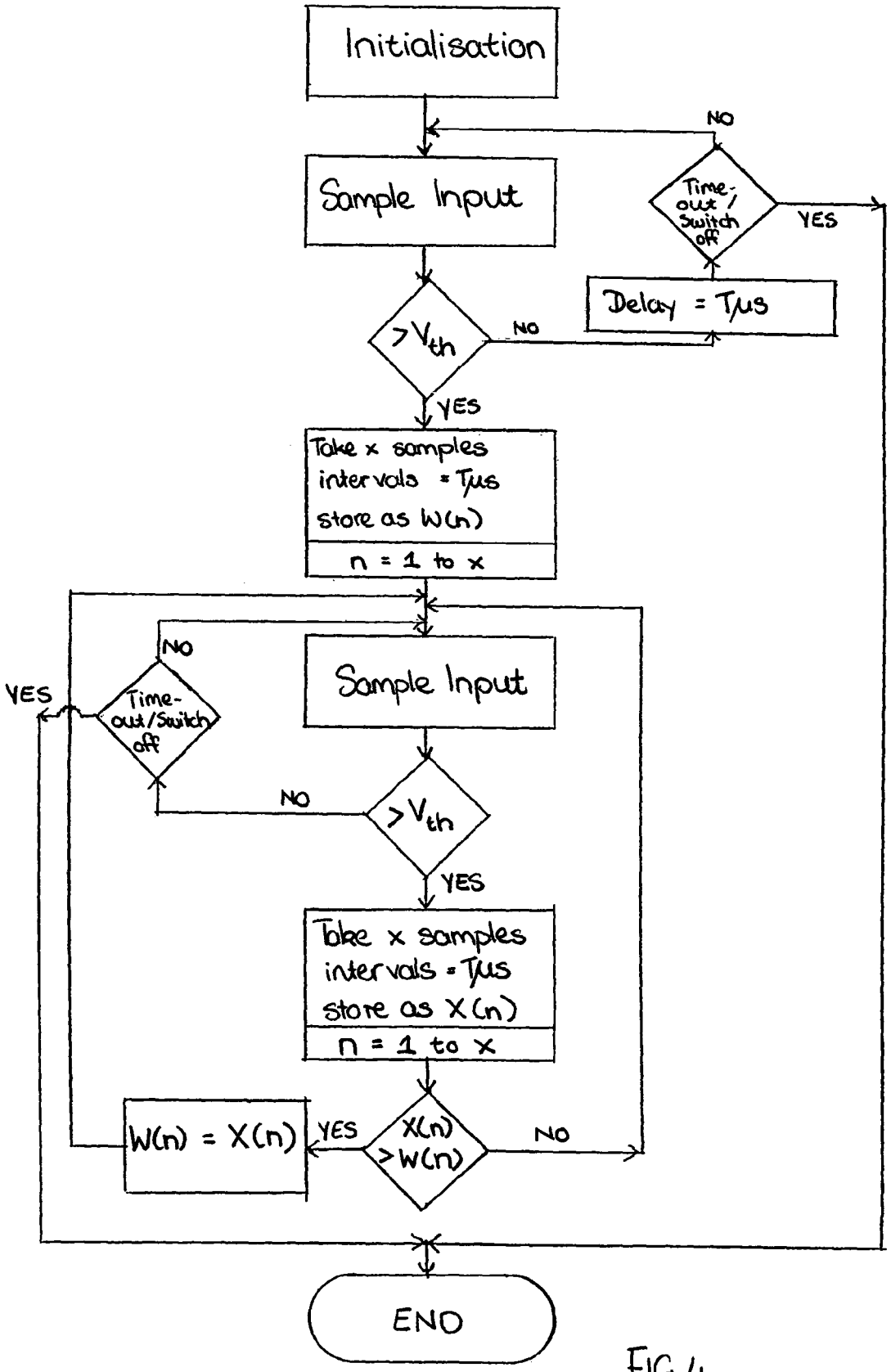
FIG. 4 shows a sensitivity adjustment operation to sound or vibration for the image capturing device, in accordance with the invention.

FIG. 4 shows a flow diagram of a sensitivity adjustment or envelope detection, as described above. During the time period allowed for the adjustment, the audio or vibrational inputs from the sensor of the triggering mechanism or actuator are sampled to obtain a maximum amplitude and/or the frequency spectrum associated with the maximum amplitude. The input from the sensor is monitored at regular intervals (Tμs), as shown. As soon as a preset threshold $V_{th}$ in the case of amplitude is exceeded, x consecutive samples are taken at time intervals of Tμs. These values of amplitude as a function of time, plus and minus a preset value—forming a tolerance band about the envelope—are stored as an array W(n) of values W(1) to W(x) representing the amplitude-time envelope. If, during this time period allowed for adjustment, a new, higher amplitude X(n) is sensed, a new envelope is created and replaces the values of W(n).

Figure 5:
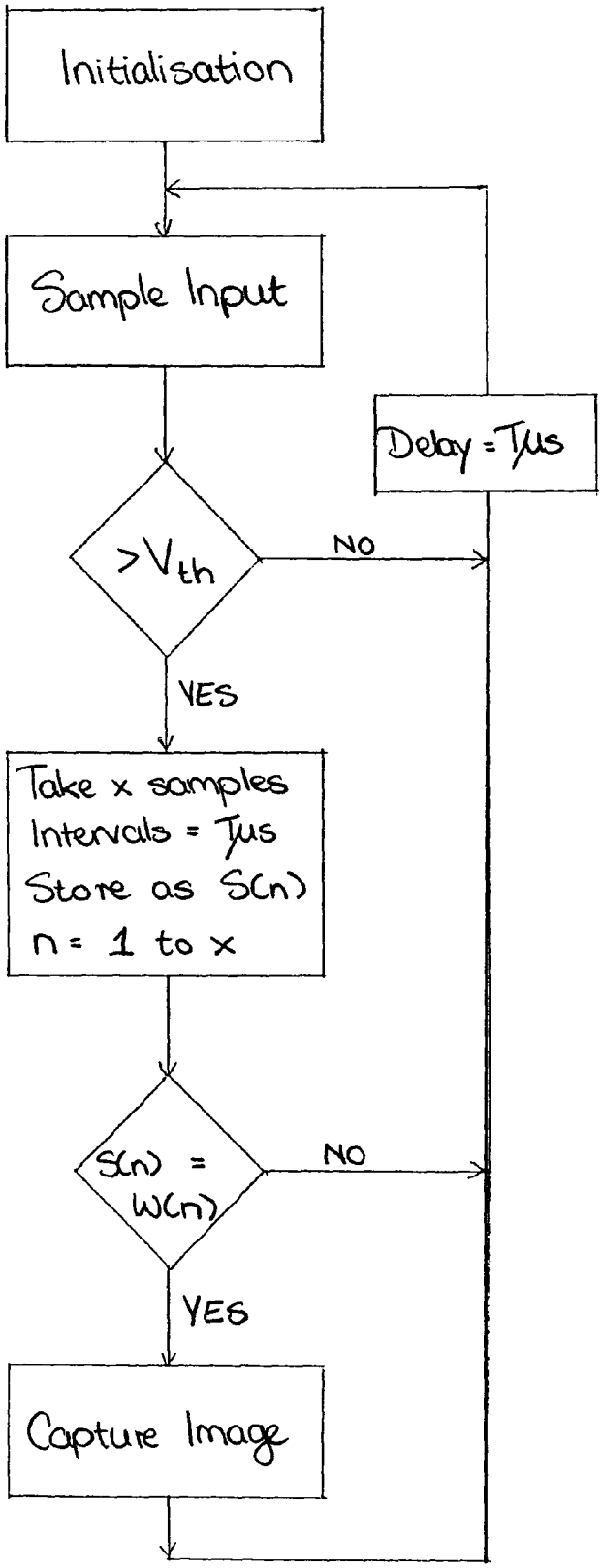
FIG. 5 shows an operational flow diagram of an image capturing device implementing a sensitivity adjusted triggering mechanism.

FIG. 5 shows a flow diagram for the image capturing device 12 set to the normal operational mode (channel 1) with the sensitivity mechanism, as described above, adjusted. After initialization, the audio input from the sensor is continuously sampled until the preset threshold $V_{th}$ is exceeded. Thereafter x consecutive samples are taken and stored as an array S(n) of values S(1) to S(x). The array S(n) is then compared to the initial stored array W(n). A correspondence between these two arrays within predetermined limits will trigger the capturing of an image by the image capturing device 12.

It is to be appreciated that the control system on 12 makes the application of the simulator 10 more flexible and user-friendly than existing systems. The control system 22, or parts thereof may also be mounted on the firearm 14, as determined by size and weight constraints. The control system of element 12 comprises certain functions and modes of operation where the operation or status of the emitter or image capturing device 12 can be adjusted or interrogated by means of a switch.

Some of the possible modes include the zeroing mode and the sensitivity adjustment mode, as described above. In addition, the system may also include operations like confirming input, the reset of functions, determining the number of flashes or images captured since a previous reset register, battery charge level, laser flashing settings or image capturing settings, e.g. time between flashes or images captured in the trace mode, cycling between modes or channels of operation, and/or the like. The control system is operated via a switch, typically manually activated via a small touch control type switch, or the like. Where components of the control system are separated, e.g. mounted on the firearm and a separate processor, suitable communication between these components will be in place, typically of the wireless kind, such as by means of infrared or radio-frequency means.

Referring now to FIG. 6, the invention also includes an attachment or mounting mechanism for the image capturing device 12. One embodiment of such mounting mechanism will now be discussed in more detail.

Figure 6A:
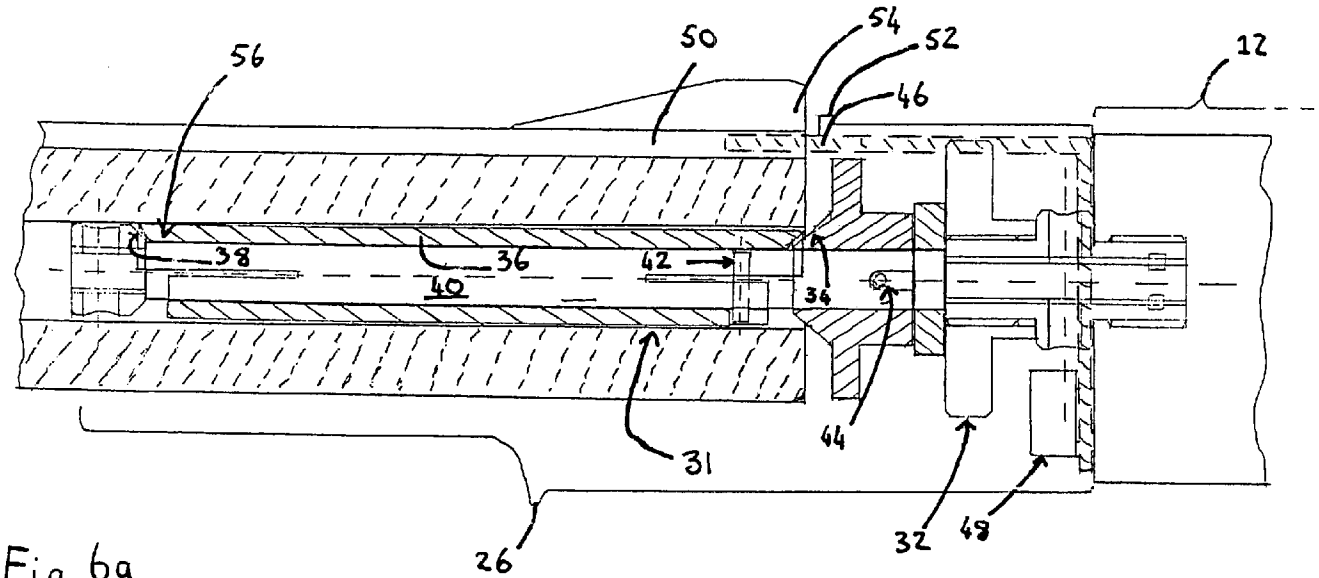
FIG. 6*a* shows, in side-sectional view, a mounting mechanism for a firearm shooting simulator image capturing device.

FIG. 6*a* shows a preferred embodiment of the mounting mechanism 26 for the image capturing device, collectively indicated by reference numeral 12. The mounting mechanism 26 frictionally locks the attachment 12 inside a muzzle 31 of the firearm 14. The turning of nut 32 pushes wedge 34 under the lip of sleeve 36, typically manufactured from a resiliently flexible material. At the same time, wedge 38 is pulled under the lip at the other end of sleeve 36 through the link of 38 to nut 32 through central core or spindle 40.

These two lips at the ends of sleeve 36 presses against the muzzle 31, frictionally locking the attachment 12 inside the barrel or muzzle 31. A high precision mounting is achieved partially through the removal of concentricity problems as follows: pins 42 and 44 always keep the same wedging surfaces in contact, and the two lips of the sleeve 36 only press to one side of the barrel's interior surface. Precision is further increased through a barrel stop 46, adjustably attached to attachment 12 with screw 48, to abut against a part of the firearm suitably protruding. In an embodiment shown, this is the front sight post 50. An alternative to the barrel stop 46 is a similarly adjustable (or non-adjustable) alignment indicator 52 in close proximity to the front sight 54, for example.

Figure 6B:
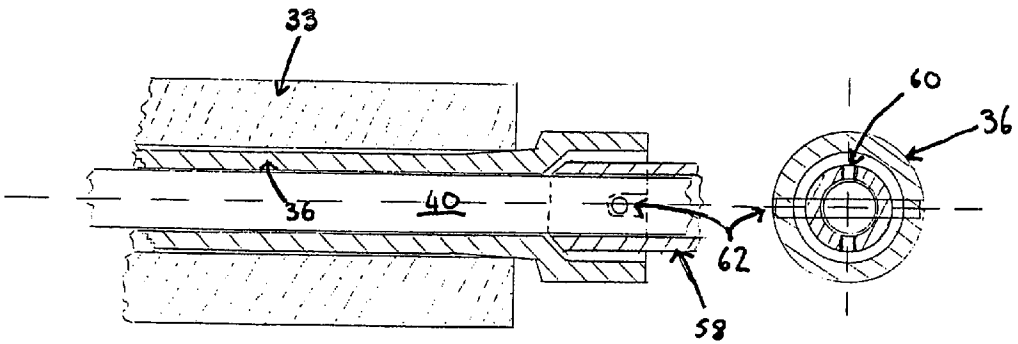
FIG. 6*b* shows a further embodiment of the mounting means of FIG. 6*a*.

FIG. 6*b* shows a further embodiment of the mounting mechanism 26, wherein the muzzle end of main sleeve 36 is tapered to tightly fit in the muzzle opening of barrel 33. At the other end of the sleeve 36, the same wedge 38 will be pulled by central core or spindle 40 so that lip 56 is locked inside the barrel. In further embodiments, there may be two or more lips to be forced by wedge 38. In place of wedge 34, wedge 58's collet sleeve split longitudinally at 60, will during the locking operation in collet-like fashion grip spindle 40 and become wedged between core 40 and sleeve 36 to help minimize inaccuracies due to manufacturing tolerances in the concentricity of parts. In the shown embodiment, pin 62 ensures that the same wedging surfaces are always kept in contact, in use.

Main sleeve 36 or the tapered part can be manufactured from a soft material, e.g. an elastomer, to be indented by the barrel rifling to resist rotation of the mounting in the barrel, in use, or the like. It is to be appreciated that more general embodiments of the mounting mechanism are possible, in accordance with the invention.

Figure 7:
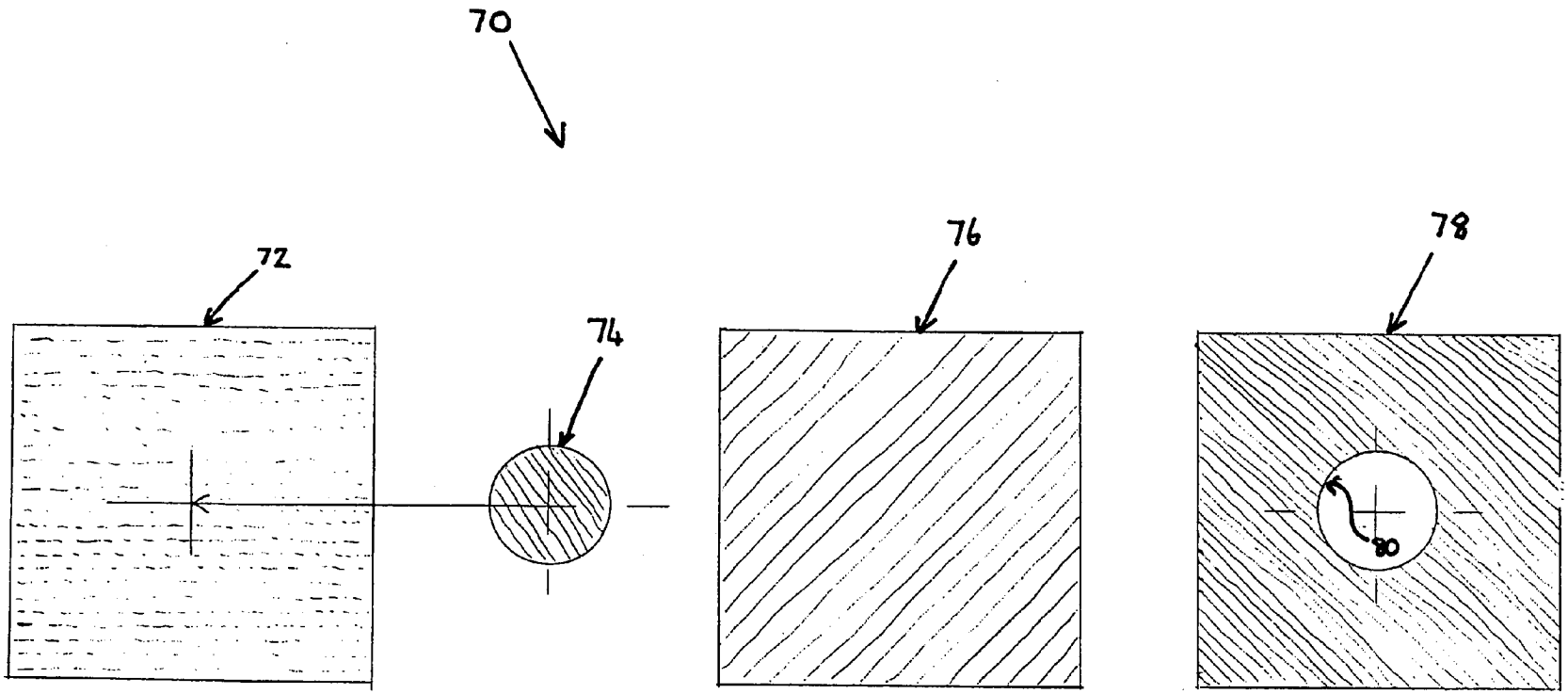
FIG. 7 shows an exploded view of one embodiment of a target for a firearm shooting simulator in accordance with the invention.

With reference now to FIG. 7, this relates to an embodiment of the invention wherein the image capturing device 12 is replaced with a laser beam emitter and shows a target 70 for a firearm shooting simulator including such an emitter. The target 70 typically includes a plurality of layers, with the target 70 being configured so that an electromagnetic beam or laser striking the target, in use, passes through similar layers irrespective of where the beam hits the target and thus experiences the same degree of diffusion and absorption over the entire target area. By ensuring that the target 70 is comprised of layers which provide a uniform target body for the beam to traverse, accurate detection of an impact point is allowed.

FIG. 7 shows the layering of colours on a screen which constitutes a diffusing target where a light beam, e.g. a laser, is emitted from a firearm and sensors, typically photodiodes, are used behind the screen to determine the centroid where the beam strikes the target. The target 70 includes a main screen 72 manufactured from a transparent material such as matt lexan/polycarbonate with a rough, non-reflective surface to aim at, and a smooth surface with layers of colour on the reverse side thereof. The layers can be printed, painted, glued or applied in any suitable manner.

Reference numeral 74 represents a dark coloured roundel, e.g. red, on the target centre—the target bull's-eye area—which is applied first to the screen 72. Then a diffusing material layer 76 is applied over the whole target area, including over the roundel 74. This diffusing layer 76 may be white or include white pigment to form the target background colour. Reference numeral 78 represents another layer of the same material or having the same light transparency and/or diffusiveness as roundel 74, with a corresponding portion 80 missing, to ensure a similar diffusion path through the target 70.

Greater accuracy and consistency in shooting results can be achieved in the case of a light emitter when the colours and diffusing material of the target are deposited on the screen 72 in such a fashion that light shot on the target will experience the same degree of diffusion and absorption on the whole target irrespective of the colour visible from the front thereof. This allows consistent incidence of a light beam traversing the target upon a scanner or similar photosensors which determines where the light hits the target.

Although only certain embodiments of the invention have been described herein, it will be understood by any person skilled in the art that other modifications, variations, and possibilities of the invention are possible. Such modifications, variations and possibilities are therefore to be considered as falling within the spirit and scope of the invention and hence forming part of the invention as herein described and/or exemplified.

It shall further be understood that the examples are provided for illustrating the invention further and to assist a person skilled in the art with understanding the invention and is not meant to be construed as unduly limiting the reasonable scope of the invention.

The inventors regard it as an advantage that the invention provides for a system and associated method for simulated firearm shooting without requiring exact alignment of the sights of the firearm or the sights with the simulator. The inventors regard it as a further advantage that the invention includes an actuating mechanism allowing triggering of the simulator to capture an image or emit a beam only when the firearm itself is triggered.

The inventors regard it as a yet further advantage that the invention provides for an attachment mechanism whereby an image capturing device or a beam emitter is attachable to a firearm in an accurate and repeatable manner.

The invention claimed is:

1. A zeroing method for a firearm shooting simulator, which method includes at least the steps of:

sighting a firearm having an image capturing device associated therewith, aiming at a first point on a target, which first point is a centre of the target;

capturing at least one image of the target;

automatically determining a second point on the target corresponding to a centre of the image captured;

automatically determining any variance between the first and second points by quantifying the distance and direction of the variance between the first and second points;

when the firearm shooting simulator is in a post-zeroing, shooting condition, automatically compensating for the variance when further images are captured, so that accurate zeroing of the firearm shooting simulator at the target is achievable without having to precisely align two or more of the image capturing device, a barrel of the firearm, and a sight of the firearm with each other; and automatically creating a virtual target centre by calculating the mean point of impact (MPI) using one or more second points.

2. A zeroing method as claimed in claim 1, wherein the target is a reference system representing the target.

3. A zeroing method as claimed in claim 1, wherein second points that are unwanted and/or are further than a predetermined distance from the MPI are discarded during zeroing.

4. A zeroing method as claimed in claim 1, wherein a perfect firearm to visible target centre alignment results in a centre simulator hit on the MPI and wherein a virtual target hit a certain distance and direction from the MPI is registered as a hit on the real target the same distance and direction from the target centre.

5. A zeroing method as claimed in claim 1, wherein the variance for a particular firearm located a known distance from a target is stored in a memory arrangement from which this information is retrievable.

6. A zeroing method as claimed in claim 1, wherein the capturing of the one or more images is triggered by a predetermined signal associated with dry-firing, firing, or triggering of the firearm.

7. A firearm shooting simulator system including:— an image capturing device configured for fitment to a firearm, in use, which device is configured to capture at least one image of a target, wherein a centre of said image represents a virtual point of impact on the target;

a processor arranged in communication with the image capturing device, which processor is configured to determine any variance between said virtual point of impact and a point on the target sighted by the firearm when the image is captured, by quantifying the distance and direction of the variance between the virtual point of impact and the point sighted by the firearm and to compensate for such variance when further images are captured during post-zeroing, simulator shooting; and a reporting mechanism arranged in communication with the processor, which reporting mechanism is configured to indicate where the firearm is sighted at the target once further images are captured and the variance compensated for, as compensation for the variance obviates alignment of the image capturing device with a sight of the firearm;

wherein during post-zeroing condition simulated shooting, the processor compensates for the variance by adjusting the virtual point of impact of a further image captured by the variance so that further virtual points of impact are automatically adjusted with such variance.

8. A system as claimed in claim 7, wherein the processor is configured to determine the mean variance by considering multiple images captured of the target in order to determine a mean point of impact (MPI) of the plurality of virtual points of impact.

9. A system as claimed in claim 8, wherein the MPI for a particular firearm located a known distance from a target is stored in a memory arrangement from which this information is retrievable.

10. A system as claimed in claim 9, wherein the memory arrangement stores a plurality of mean points of impact, each MPI being associated with a particular firearm shooting simulator located at a particular distance from the target so that a user can select an MPI associated with a particular firearm shooting simulator located at a particular distance from the target and wherein any selected MPI is deletable.

11. A system as claimed in claim 7, wherein the capturing of the at least one image is triggered by a predetermined signal or set of signals associated with dry-firing, firing, or triggering of the firearm and wherein the system includes a sensor for sensing the predetermined signal and an actuator having an adjustable sensitivity configured to monitor the sensor, the actuator further being configured to activate the image capturing device when the predetermined signal is sensed by the sensor, so that the image capturing device is only activated upon receipt of the predetermined signal.

12. A system as claimed in claim 11, wherein the sensor is selected from an acoustic sensor and a vibration sensor.

13. A system as claimed in claim 11, wherein the predetermined signal includes particular characteristics selected from the group including: amplitude-time, frequency spectrum, and amplitude-time and frequency spectrum.

14. A system as claimed in claim 13, wherein the predetermined signal includes a peak level of amplitude and/or a predetermined interval of amplitude before and/or after said peak.

15. A system as claimed in claim 11, wherein, in an adjustment mode, the actuator is configured to record the predetermined signal associated with a particular firearm and to store it.

16. A system as claimed in claim 15, wherein the actuator is capable of storing a plurality of predetermined signals, wherein each predetermined signal is associated with a particular firearm, and wherein the user has a choice which signal to use and which to delete.

17. A system as claimed in claim 7, wherein the processor downloads a predetermined portion of the image captured of the target, wherein the size of the portion downloaded for the calculation of simulated shooting results is a fraction of the size of the image captured and wherein the downloaded portion overlays the captured target image.

18. A system as claimed in claim 17, wherein the dimensions and/or shape of the downloaded portion are adjustable.

19. A system as claimed in claim 7, wherein the reporting mechanism includes a display which shows a virtual representation of the target with an indication of where the virtual points of impact calculated by the processor are located.

20. A system as claimed in claim 7, wherein the system is operable in a plurality of selectable modes with shooting mode in which a single image is captured upon simulated firing of the firearm and a tracing mode in which images are captured at set time intervals so that movement of the firearm barrel during zeroing, aiming, or shooting is traceable.

* * * * *